US010276106B2

(12) United States Patent
Lee et al.

(10) Patent No.: US 10,276,106 B2
(45) Date of Patent: Apr. 30, 2019

(54) POWER SUPPLY AND DISPLAY DEVICE

(71) Applicant: SAMSUNG ELECTRONICS CO., LTD., Suwon-si (KR)

(72) Inventors: Sang-hoon Lee, Suwon-si (KR); Jeong-il Kang, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 134 days.

(21) Appl. No.: 14/952,226

(22) Filed: Nov. 25, 2015

(65) Prior Publication Data

US 2016/0358554 A1 Dec. 8, 2016

(30) Foreign Application Priority Data

Jun. 5, 2015 (KR) ..... 10-2015-0079929

(51) Int. Cl.
*G09G 3/34* (2006.01)
*H05B 33/08* (2006.01)

(52) U.S. Cl.
CPC ..... *G09G 3/3406* (2013.01); *G09G 3/342* (2013.01); *H05B 33/0815* (2013.01); *H05B 33/0845* (2013.01); *G09G 2320/0646* (2013.01); *G09G 2330/00* (2013.01)

(58) Field of Classification Search
CPC ..... G09G 3/3406; G09G 2320/0646; H05B 33/0815; H05B 33/0848; H02M 3/1582
USPC ..... 345/212
See application file for complete search history.

(56) References Cited

U.S. PATENT DOCUMENTS 4,992,821 A * 2/1991 Kiuchi ..... G03B 7/26 396/129
5,330,359 A * 7/1994 Walker ..... H05K 7/023 439/69
2006/0261752 A1* 11/2006 Lee ..... H05B 33/0857 315/291
2010/0177127 A1 7/2010 Akiyama et al.
2011/0090261 A1* 4/2011 Kang ..... H05B 33/0848 345/690
2012/0038290 A1 2/2012 Choi et al.
2012/0044277 A1* 2/2012 Adachi ..... G09G 3/3426 345/690
2012/0120123 A1* 5/2012 Adachi ..... G09G 3/342 345/690
2013/0278170 A1 10/2013 Ascorra et al.
2016/0135263 A1* 5/2016 Chen ..... F21K 9/60 315/200 R

FOREIGN PATENT DOCUMENTS

KR 10-1440331 B1 9/2014

OTHER PUBLICATIONS

Linear Technology Technical Bulletin, Copyright 2010, pp. 1-22.*
(Continued)

*Primary Examiner* — Yuzhen Shen
(74) *Attorney, Agent, or Firm* — Sughrue Mion, PLLC

(57) ABSTRACT

A display device is provided, which includes a panel configured to display an image using an LED backlight configured to emit light incident on the panel, an image signal interface configured to provide an image signal to the panel, and a power supply including an LED driver configured to generate constant current, wherein the LED driver is detachable from the power supply.

19 Claims, 13 Drawing Sheets

(56) References Cited

OTHER PUBLICATIONS

Linear Technology Technical Bulletin, pp. 1-22, Publsihed on line on Jun. 4, 2013.*
Communication dated Oct. 7, 2016, issued by the European Patent Office in counterpart European Application No. 15197995.2.

* cited by examiner

POWER SUPPLY AND DISPLAY DEVICE

CROSS-REFERENCE TO RELATED APPLICATION

This application claims priority from Korean Patent Application No. 10-2015-0079929 filed on Jun. 5, 2015 in the Korean Intellectual Property Office, the disclosure of which is incorporated herein by reference in its entirety.

BACKGROUND

Field

Methods and apparatuses consistent with exemplary embodiments relate to a power supply and a display device having the same, and more particularly, to a power supply that can drive light emitting diodes (LEDs) using an LED driver that is separable from the power supply and a display device having the same.

Description of Related Art

A liquid crystal display (LCD) may be thin, light weight, powered by a low driving voltage and have low power consumption in comparison to other display devices, and thus has been widely used. However, because the liquid crystal display is a non-light emitting device (not self-luminous), a separate backlight for supplying light to a liquid crystal display panel is necessary.

As a backlight light source of the liquid crystal display, a cold cathode fluorescent lamp (CCFL) or a light emitting diode (LED) is mainly used. The cold cathode fluorescent lamp uses mercury, and thus has the drawbacks that it causes environmental pollution, has low response speed and low color reproduction, and thus is not appropriate to a light, thin, short, and small LCD panel.

In contrast, the light emitting diode is environmentally-friendly because it does not use an environmentally harmful material. Further, the light emitting diode has superior color reproduction. Further, luminance and color temperature can be optionally changed through control of red, green, and blue light emitting diodes. Further still, the light emitting diode is appropriate for a light, thin, short, and small LCD panel, and thus it has recently been adopted as a light source for a backlight of an LCD panel.

On the other hand, the light emitting diode is driven by constant current, and in the case where the backlight unit is composed of the light emitting diodes, an LED driving circuit for providing constant current to the light emitting diodes is provided.

Recently, the LED driving circuit is implemented in various forms in accordance with the driving type thereof. In the related art, the LED driving circuit is individually designed according to the driving type of the display device (or driving type of the backlight). Specifically, the LED driving circuit is differently configured according to the backlight driving type, and various power supplies are required for the various types of LED drivers.

SUMMARY

Exemplary embodiments overcome the above disadvantages and other disadvantages not described above. Also, one or more exemplary embodiments are not required to overcome the disadvantages described above, and an exemplary embodiment may not overcome any of the problems described above.

Aspects of one or more exemplary embodiments provide a power supply that can drive LEDs using an LED driver that is separable from the power supply and a display device having the same.

According to an exemplary embodiment, there is provided a display device including: a panel configured to display an image; an LED backlight configured to emit light incident on the panel; an image signal interface configured to provide an image signal to the panel; and a power supply including an LED driver configured to generate constant current to be provided to the LED backlight. The LED driver is detachable from the power supply.

The power supply may include: a circuit board; a power generator arranged on the circuit board, the power generator configured to generate a DC voltage; a first board terminal arranged on one side of the circuit board. The first board terminal may include a power terminal configured to provide the DC voltage from the power generator to the LED driver and a signal terminal configured to receive the constant current generated by the LED driver from the LED backlight; and a second board terminal configured to provide the constant current to the LED backlight.

The LED backlight may include a plurality of LED arrays, the signal terminal may include a first plurality of sub-terminals configured to receive a plurality of constant currents, and the second board terminal may include a second plurality of sub-terminals configured to provide the plurality of constant currents to the plurality of LED arrays, respectively.

The signal terminal may be further configured to receive one constant current provided thereto, and the second board terminal may be further configured to commonly provide the one constant current provided thereto to different LED arrays of the plurality of LED arrays.

The LED driver may include: a sub-circuit board; a sub-board terminal arranged on one side of the sub-circuit board to face the first board terminal; and an LED driving circuit configured to generate the constant current using the DC voltage from the sub-board terminal and to provide the generated constant current to the sub-board terminal.

The LED driving circuit may be a buck type or a boost type.

The display device may further include a plurality of LED driving circuits, and the plurality of constant currents may be generated using different LED driving circuits of the plurality of LED driving circuits.

The power supply may further include a third board terminal configured to receive dimming information from the image signal interface, and the first board terminal may be configured to provide the received dimming information to the LED driver.

The power supply may further include a sensor configured to sense a connection state of the LED driver.

The sensor may be further configured to determine an electric potential value of a first sensor terminal of the first plurality of sub-terminals and determine the connection state based on the determined electric potential value.

The first sensor terminal may be electrically connected to a second sensor terminal constituting the first board terminal through the first plurality of terminals, and the second sensor terminal may be connected to a ground of the circuit board through a resistor.

According to an aspect of another exemplary embodiment, there is provided a power supply configured to generate a driving power to an LED driver, the power supply including: a circuit board; a power generator arranged on the circuit board, the power generator configured to generate a DC voltage; an LED driver detachably attached to the circuit board, the LED driver configured to generate constant current to be provided to an LED backlight using the generated DC voltage; a first board terminal arranged on one side of the circuit board, the first board terminal comprising a power terminal configured to provide the DC voltage from the power generator to the LED driver and a signal terminal configured to receive the constant current generated by the LED driver from the LED backlight; and a second board terminal configured to provide the constant current to the LED backlight.

The LED backlight may include a plurality of LED arrays, the signal terminal may include a first plurality of sub-terminals configured to receive a plurality of constant currents provided thereto, and the second board terminal may include a second plurality of sub-terminals configured to provide the plurality of constant currents to the plurality of LED arrays, respectively.

The signal terminal may be further configured to receive one constant current provided thereto, and the second board terminal may be further configured to commonly provide the one constant current provided thereto to different LED arrays of the plurality of LED arrays.

The LED driver may include: a sub-circuit board; a sub-board terminal arranged on one side of the sub-circuit board to face the first board terminal; and an LED driving circuit configured to generate the constant current using the DC voltage from the sub-board terminal and to provide the generated constant current to the sub-board terminal.

The LED driving circuit may be a buck type or a boost type.

The power supply may further include a plurality of LED driving circuits, and the plurality of constant currents may be generated using different LED driving circuits of the plurality of LED driving circuits.

The power supply may further include a third board terminal configured to receive dimming information from the image signal interface, and the first board terminal may be configured to provide the received dimming information to the LED driver.

The power supply may further include a sensor configured to sense an electric potential value of a first sensor terminal of the first plurality of sub-terminals and determine a connection state of the LED driver based on the determined sensed electric potential value.

The first sensor terminal may be electrically connected to a second sensor terminal constituting the first board terminal through the first plurality of terminals, and the second sensor terminal may be connected to a ground of the circuit board through a resistor.

Additional and/or other aspects and advantages of the disclosure will be set forth in part in the description which follows, or may be learned by practice of the disclosure.

BRIEF DESCRIPTION OF THE DRAWING

The above and/or other aspects of the present disclosure will be more apparent by describing exemplary embodiments with reference to the accompanying drawings, in which.

DETAILED DESCRIPTION OF EXEMPLARY EMBODIMENTS

Figure 1:
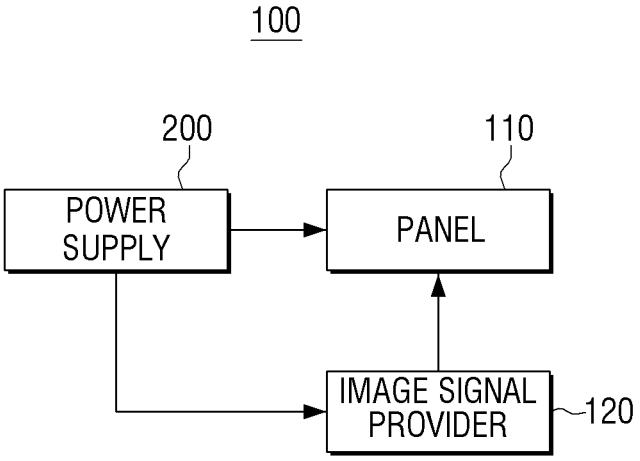
FIG. 1 is a block diagram illustrating the schematic configuration of a display device according to an exemplary embodiment.

The exemplary embodiments of the present disclosure may be diversely modified. Accordingly, specific exemplary embodiments are illustrated in the drawings and are described in detail in the detailed description. However, it is to be understood that the present disclosure is not limited to a specific exemplary embodiment, but includes all modifications, equivalents, and substitutions without departing from the scope and spirit of the present disclosure. Also, well-known functions or constructions may not be described in detail because they would obscure the disclosure with unnecessary detail.

The terms "first", "second", etc. may be used to describe diverse components, but the components are not limited by the terms. The terms are only used to distinguish one component from the others.

The terms used in the present application are only used to describe exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof. Expressions such as "at least one of," when preceding a list of elements, modify the entire list of elements and do not modify the individual elements of the list.

In the exemplary embodiment of the present disclosure, a "module" or a "unit" performs at least one function or operation, and may be implemented with hardware, software, or a combination of hardware and software. In addition, a plurality of "modules" or a plurality of "units" may be integrated into at least one module, except for a "module"

or a "unit" which has to be implemented with specific hardware, and may be implemented with at least one processor.

Hereinafter, exemplary embodiments will be described in detail with reference to the accompanying drawings.

FIG. 1 is a block diagram illustrating the schematic configuration of a display device according to an exemplary embodiment.

Referring to FIG. 1, a display device 100 according to an exemplary embodiment may include a panel 110, an image signal interface 120, and a power supply 200.

The panel 110 displays an image using an LED backlight. The panel 110 may be an LCD panel that displays grayscales by allowing light emitted from the LED backlight unit penetrate an LCD and controlling the degree of penetration. Accordingly, the panel 110 receives power that is required for the LED backlight through the power supply 200, and creates the light that is emitted from the LED backlight penetrate the LCD. Further, the panel 110 may receive a power to be used for a pixel electrode and a common electrode from the power supply 200, and may display an image through adjustment of the LCD in accordance with the image signal input from the image signal interface 120.

Here, the backlight is to emit light to the LCD, and may be composed of a cold cathode fluorescent lamp (CCFL) or a light emitting diode (LED). Hereinafter, it is exemplified that the backlight is composed of light emitting diodes and a light emitting diode driving circuit. However, in implementation, the backlight may also be implemented by other configurations.

On the other hand, in the case of using the light emitting diodes, the backlight may be provided with an LED driver for driving the LED. Specifically, the LED driver is configured to provide constant current that corresponds to a brightness value to the LED so that the backlight operates with the brightness value that corresponds to dimming information provided from the image signal interface 120. In an exemplary embodiment, the LED driver is not arranged on a circuit board, like other power supplies, but is arranged on a separate sub-circuit board that is separable from the corresponding circuit board so that the LED driver is detachable. The LED driver on which the LED driver is arranged will be described with reference to FIGS. 9 to 13.

The image signal interface 120 provides an image signal to the panel 110. Specifically, the image signal interface 120 supplies image data and/or various image signals for displaying the image data to the panel 110 corresponding to the image data. Here, the image signal has a light emitting period for transferring information of light emitting levels and an addressing period for transferring address information for applying the light emitting period. At least one light emitting period and one addressing period are provided for each frame period.

The power supply 200 supplies power to elements in the display device 100. Specifically, the power supply 200 includes an LED driver for generating constant current to be provided to the LED backlight, and provides a driving power to the LED driver. Here, the LED driver is arranged to be detachable from the power supply 200. The detailed configuration and operation of the power supply 200 will be described later with reference to FIGS. 4 to 13.

Figure 2:
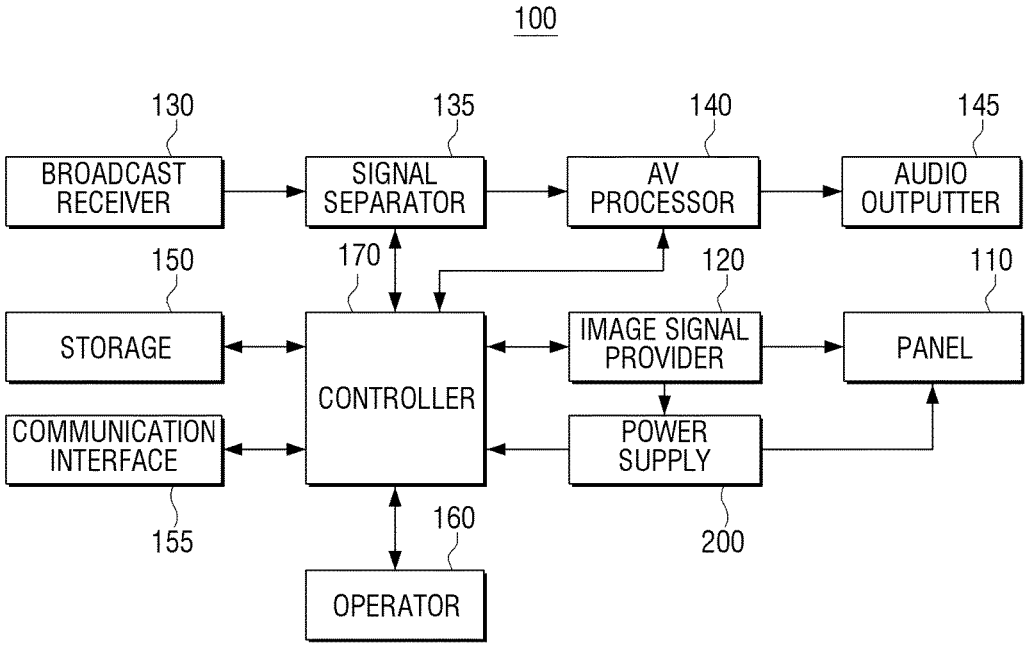
FIG. 2 is a block diagram illustrating the detailed configuration of a display device according to an exemplary embodiment.

Although a simple configuration of the display device 100 has been described, the display device 100 may include a configuration as illustrated in FIG. 2.

FIG. 2 is a block diagram illustrating the detailed configuration of a display device according to an exemplary embodiment.

Referring to FIG. 2, a display device 100 according to an exemplary embodiment includes a panel 110, an image signal interface 120, a broadcast receiver 130, a signal separator 135, an AV processor 140, an audio outputter 145, a storage 150, a communication interface 155, an operator 160, a controller 170, and a power supply 200.

The operations of the panel 110 and the power supply 200 are the same as those as illustrated in FIG. 1, and thus the duplicate explanation thereof will be omitted. On the other hand, although it is illustrated that the power supply 200 supplies the power only to the panel 110 and the controller 170, the power supply 200 can provide the power to all constituent elements that require the power in the display device 100.

The broadcast receiver 130 receives and demodulates a broadcasting signal by wire or wirelessly from a broadcasting station or a satellite.

The signal separator 135 separates the broadcasting signal into an image signal, an audio signal, and additional information. Then, the signal separator 135 transfers the image signal and the audio signal to the AV processor 140.

The AV processor 140 performs signal processing, such as video decoding, video scaling, and audio decoding with respect to the image signal and the audio signal input from the broadcast receiver 130 and the storage 150. Further, the AV processor 140 outputs the image signal to the image signal interface 120 and outputs the audio signal to the audio outputter 145.

On the other hand, in the case of storing the received image and audio signals in the storage 150, the AV processor 140 may output the image and audio signals in a compressed form to the storage 150.

The audio outputter 145 converts the audio signal output from the AV processor 140 into a sound, and includes a speaker or an external output terminal to output the sound to an external device.

The image signal interface 120 generates a GUI (Graphic User Interface). Further, the image signal interface 120 adds the generated GUI to an image that is output from the AV processor 140. Further, the image signal interface 120 provides the image signal corresponding to the image added with the GUI to the panel 110. Accordingly, the panel 110 displays various kinds of information provided from the display device 100 and the image transferred from the image signal interface 120.

Then, the image signal interface 120 may extract brightness information that corresponds to the image signal, and may generate a dimming signal that corresponds to the extracted brightness information. Then, the image signal interface 120 may provide the generated dimming signal to the power supply 200. The dimming signal may be a PWM signal.

The storage 150 may store video content. Specifically, the storage 150 may receive and store video content in which an image signal and an audio signal are compressed from the AV processor 140, and may output the stored video content to the AV processor 140 under the control of the controller 170. On the other hand, the storage may be implemented by a hard disc, a nonvolatile memory, or a volatile memory.

The operator 160 may be implemented by a touch screen, a touchpad, key buttons, and a keypad, and may provide user operation of the display device 100. In an exemplary embodiment, it is exemplified that a control command is input through the operator 160 provided in the display device 100. However, the operator 160 may receive the user operation from an external control device (for example, remote controller).

The communication interface 155 is formed to connect the display device 100 to an external device, and the connection with an external device may be performed not only by LAN (Local Area Network) and the Internet but also through a USB (Universal Serial Bus) port.

The controller 170 controls the whole operation of the display device 100. Specifically, the controller 170 may control the image signal interface 120 and the panel portion 110 so that the image according to the control command input through the operator is displayed.

As described above, because the display device 100 according to an exemplary embodiment uses a separable LED driver, the number of developments of the whole power supply can be reduced, and it is possible to upgrade the main circuit and the backlight driving circuit. Further, by commonizing the main board of the power supply, costs that are required to acquire single product safety standard can be saved, and even in the case where the backlight driving circuit is out of order, only the corresponding module needs to be replaced, and thus the maintenance cost can be saved.

On the other hand, in explaining FIG. 2, it is exemplified that the above described function is applied only to the display device that receives and displays the broadcast. However, the power supply to be described later may be applied to any electronic device provided with the LED backlight.

On the other hand, although it is described that the power supply 200 is included in the display device 100, the function of the power supply 200 may be implemented by a separate device.

Figure 3:
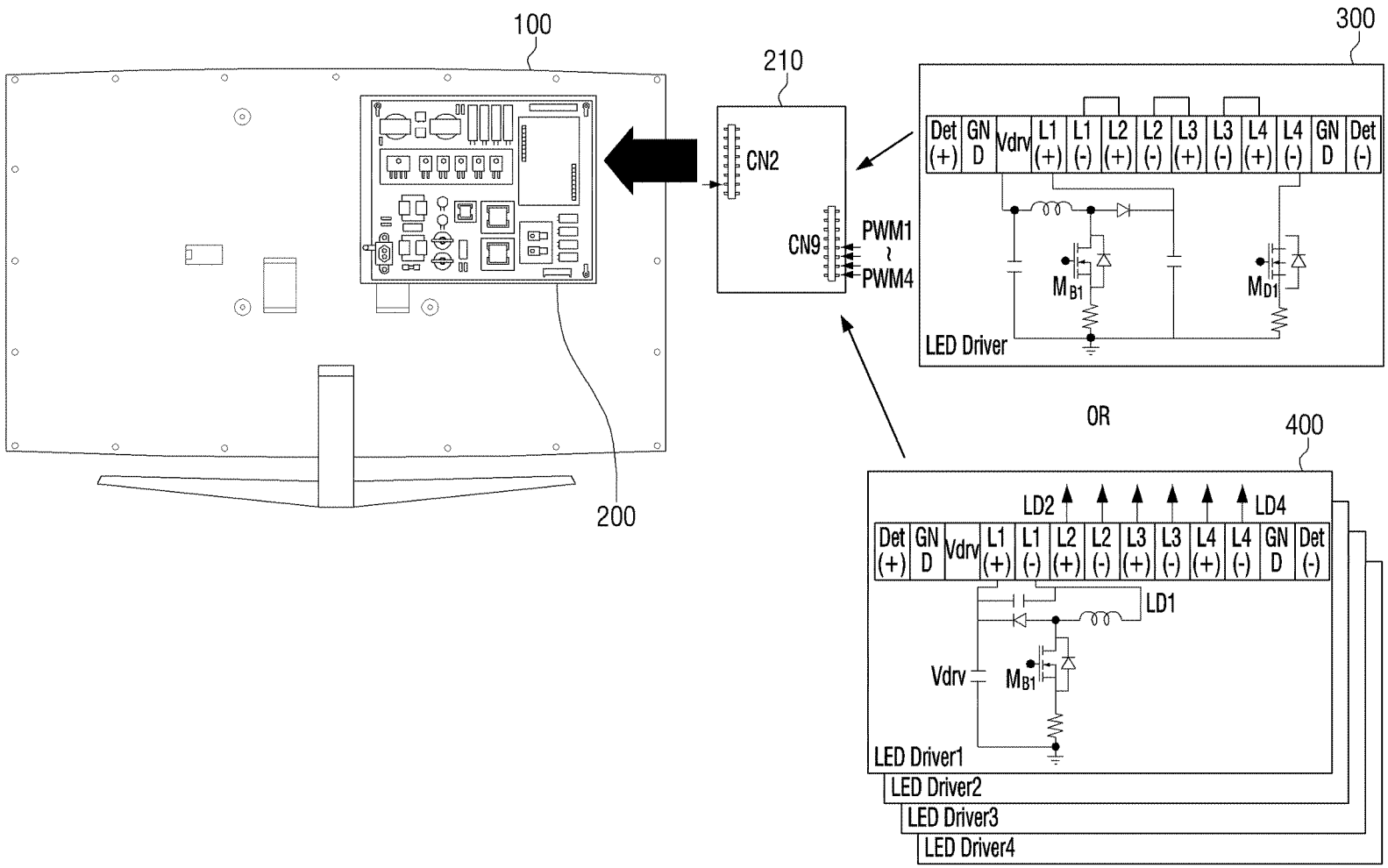
FIG. 3 is a view illustrating an arrangement of a power supply on a display device according to an exemplary embodiment.

FIG. 3 is a view illustrating an arrangement of a power supply on a display device according to an exemplary embodiment.

Referring to FIG. 3, the power supply 200 is arranged on the rear surface of the display device 100. Specifically, the power supply 200 is arranged on the rear surface of the panel 110, and can be exposed through a partial region of a case (i.e., region in which the power supply 200 is arranged).

Further, the LED driver 300 and 400 may be arranged on the circuit board 210 constituting the power supply 200 to be detachable from the corresponding circuit board 210.

Accordingly, a user can replace the LED driver 300 and 400 included in the power supply 200 by detaching only the corresponding case region without disassembling the respective constituent elements of the display device 100 from the case.

Figure 4:
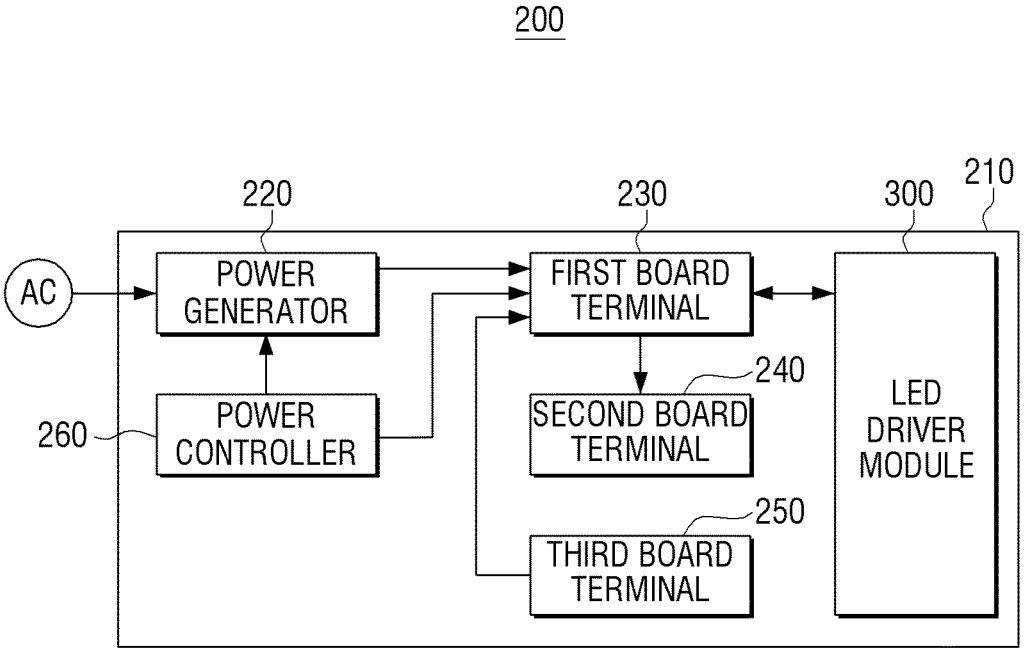
FIG. 4 is a block diagram illustrating the detailed configuration of a power supply according to an exemplary embodiment.
Figure 5:
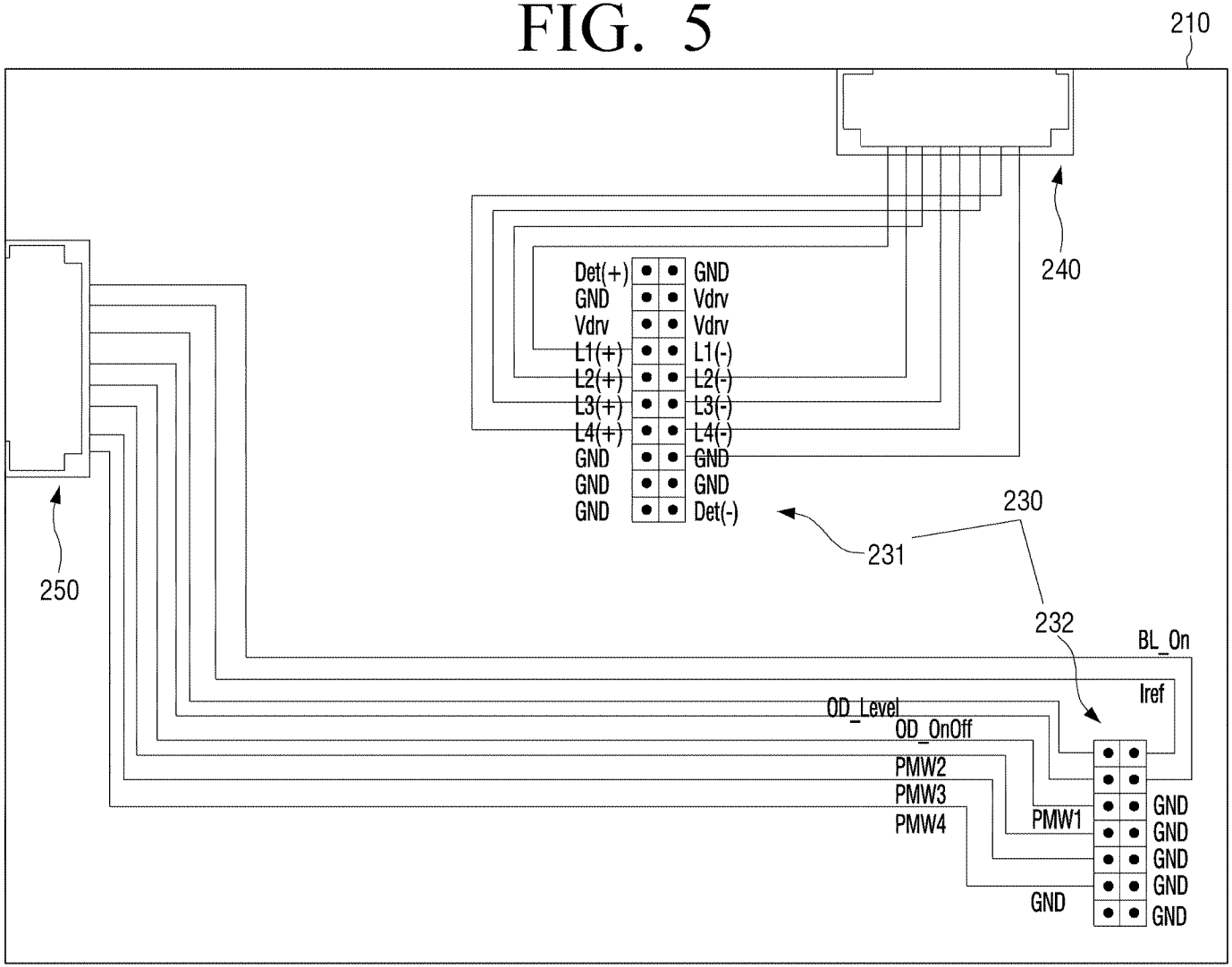
FIG. 5 is a circuit diagram of a power supply according to an exemplary embodiment.

FIG. 4 is a block diagram illustrating the detailed configuration of a power supply according to an exemplary embodiment, and FIG. 5 is a circuit diagram of a power supply according to an exemplary embodiment.

Referring to FIGS. 4 and 5, a power supply 200 includes a circuit board 210, and a power generator 220, a first board terminal 230, a second board terminal 240, a third board terminal 250, and a power controller 260 may be arranged on the circuit board 210.

The circuit board 210 includes the power generator 220, the first board terminal 230, the second board terminal 240, the third board terminal 250, and the power controller 260 that are arranged on the circuit board 210, and may be a single-side circuit board or a double-side circuit board. Further, on the circuit board 210, a circuit pattern for interfacing the respective constituent elements in the power supply 200 is formed.

The power generator 220 is arranged on the circuit board 210, and generates the DC voltage. Specifically, the power generator 220 may receive an input of an AC power, and may generate a driving power that is required for the LED driving circuit by performing primary rectification, transforming, and secondary rectification of the input AC power. In an exemplary embodiment, it is described that the power generator 220 receives an input of the AC power from the outside, but in implementation, the DC voltage may be input from an outside. Further, although it is described that the power generator 220 generates only one driving power, in implementation, the power generator 220 may generate even the driving power having different voltage levels that are required in the display device 200.

The first board terminal 230 is arranged on one side of the circuit board 210. Specifically, the first board terminal 230 may be arranged in a predetermined region of one surface that is exposed to an outside of the circuit board 210, and may be electrically/physically connected to the sub-board terminal of the LED driver. For this connection the first board terminal 230 may include a plurality of female terminals, and the sub-board terminal may include a plurality of male terminals. Further, the first board terminal may be composed of slots, and the sub-board terminal may be composed of a plurality of terminals on the side surface of the sub-circuit board corresponding to the corresponding slots.

Further, the first board terminal 230 is composed of a plurality of terminals, and the plurality of terminals may be divided into a power terminal 231 and a signal terminal 232. In implementation, the power terminal 231 and the signal terminal 232 may be physically formed as one body, and may be divided into a plurality of groups as shown in FIG. 5.

The power terminal 231 provides the DC voltage that is generated from the power generator 220 to the LED driver 300. Specifically, the power terminal 231 may include a plurality of terminals, and may provide the DC voltage to the LED driver using at least two terminals among the plurality of terminals.

Then, the power terminal 231 may receive constant current that is generated from the LED driver 300. Specifically, the power terminal 231 may receive one constant current or a plurality of constant currents through the LED driver 300.

In the illustrated example, it is illustrated that four constant currents can be maximally provided. However, in implementation, two, three, five, or more constant currents can be provided. However, in implementation, the number of supported constant currents can be as many as needed to cover all backlight driving types used by a manufacturer. For example, if the corresponding manufacturer uses only a global dimming type and 2 local dimming type, the power terminal 232 may be provided with only terminals for providing two constant currents.

Further, the power terminal 232 includes a first sensor terminal and a second sensor terminal. Specifically, the first sensor terminal Det(+) is a terminal that is electrically connected to the second sensor terminal Det(−) constituting the first board terminal through a plurality of terminals of the sub-board terminal of the LED driver.

The second sensor terminal Det(−) is connected to a ground of the circuit board 210 through a resistor. Accordingly, if the LED driver is mounted on the power supply 200, the first sensor terminal Det(+) is electrically connected to the second sensor terminal Det(−), and has a predetermined voltage value. Accordingly, the sensor can sense whether the LED driver is connected through sensing of such a voltage value.

Further, the signal terminal 232 provides the dimming information to the LED driver 300. Specifically, the signal terminal 232 may provide the dimming information that is received through the third board terminal 250 to be described later to the LED driver 300.

The second board terminal 240 provides the received constant current to the LED backlight. Specifically, the second board terminal 240 may provide the constant current that is received through the first board terminal 230 and the circuit pattern on the circuit board 210 to the external LED backlight. In this case, the second board terminal 240 and the LED backlight may be connected to each other through a cable. Such a connection type will be described later with reference to FIG. 8.

The third board terminal 250 receives the dimming information. Specifically, the third board terminal 250 may receive the dimming information through the image signal interface 110. In this case, the third board terminal may receive other pieces of information for driving the LED (e.g., backlight driving start information, DO level, DO on/off status information, and reference value information) together with the dimming information.

The power controller 260 senses whether the LED driver 300 is mounted, and if the LED driver is not mounted, it controls the power generator 220 to not provide the driving power.

The LED driver 300 generates constant current to be provided to the LED backlight. Further, the LED driver 300 is electrically connected to the first board terminal 230 as described above, and can be detachably mounted on the power supply 200.

Specifically, the LED driver 300 may be composed of a plurality of male terminals, and the first board terminal 230 may be composed of a plurality of female terminals that can be coupled to the plurality of male terminals. Further, a plurality of terminals may be arranged on one side of the circuit board of the LED driver 300, and the first board terminal 230 may be implemented by slots to be physically and electrically connected to the plurality of terminals.

The detailed configuration and operation of the LED driver 300 will be described later with reference to FIGS. 9 to 13.

As described above, because the power supply 200 according to an exemplary embodiment uses a separable LED driver, the number of developments of the whole power supply can be reduced, and it is possible to upgrade the main circuit and the backlight driving circuit. Further, by commonizing the main board of the power supply, costs that are required to acquire single product safety standard can be saved, and even in the case where the backlight driving circuit is out of order, only the corresponding module needs to be replaced, and thus the maintenance cost can be saved.

Figure 6:
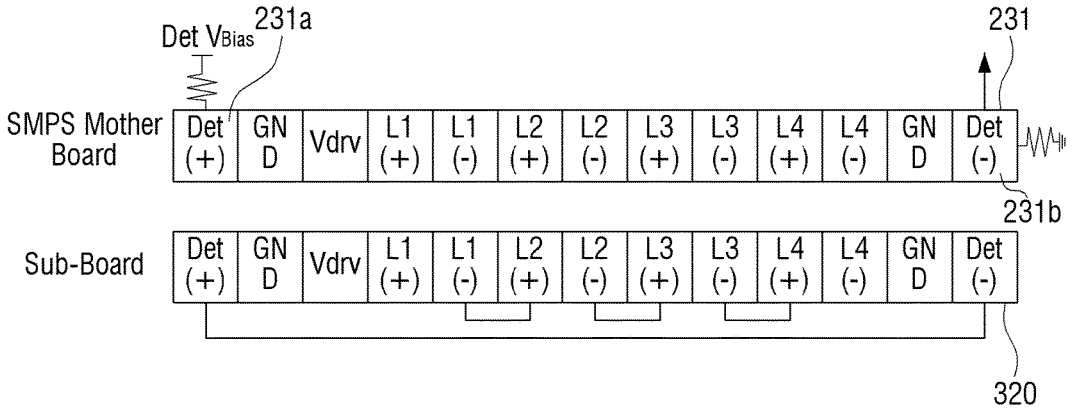
FIG. 6 is a diagram illustrating an example of a pin arrangement of a power terminal of FIG. 5.

FIG. 6 is a diagram illustrating an example of a pin arrangement of a power terminal 231 of FIG. 5.

Referring to FIG. 6, the power terminal 231 includes power terminals GND and Vdrv for providing the DC voltage, constant current receiving terminals L1(+), L1(−1), L2(+), L2(−1), L3(+), L3(−1), L4(+), and L4(−1) for receiving the constant current generated from the LED driver 300, a first sensor terminal Det(+), and a second sensor terminal Det(−).

The power terminals GND and Vdrv are terminals that provide the DC voltage that is generated from the power generator 220 to the LED driver 300. The power terminals may be connected to the power terminals of the sub-board terminal of the LED driver 300.

The constant current receiving terminals L1(+), L1(−1), L2(+), L2(−1), L3(+), L3(−1), L4(+), and L4(−1) are terminals for receiving the constant current that is generated from the LED driver 300. On the other hand, in the case where the LED driver 300 generates only one constant current, the constant current is provided through two terminals, and other 6 terminals are connected to each other (L1(−1) and L2(+), L2(−1) and L3(+), and L3(−1) and L4(+)) as illustrated in FIG. 6, and thus a plurality of LED arrays are connected in series.

The first sensor terminal 231*a* and the second sensor terminal 231*b* are terminals that are used to sense whether the LED driver 300 is connected.

The first sensor terminal 231*a* is connected to the first sensor terminal of the sub-board terminal 320 in a state where the LED driver 300 is mounted, and the first sensor terminal of the sub-board terminal 320 is electrically connected to the second sensor terminal of the sub-board terminal 320 through the circuit pattern of the sub-circuit board. Further, the second sensor terminal of the sub-board terminal 320 is connected to the second sensor terminal 231*b* of the power terminal 231 in a state where the LED driver 300 is mounted.

Accordingly, if the LED driver 300 is mounted on the power supply, the voltage of the first sensor terminal 231*a* is divided through the resistor connected to the second sensor terminal 231*b*. Accordingly, the sensor can sense whether the LED driver 300 is mounted on the basis of the power value of the first sensor terminal 231*a*.

Figure 7:
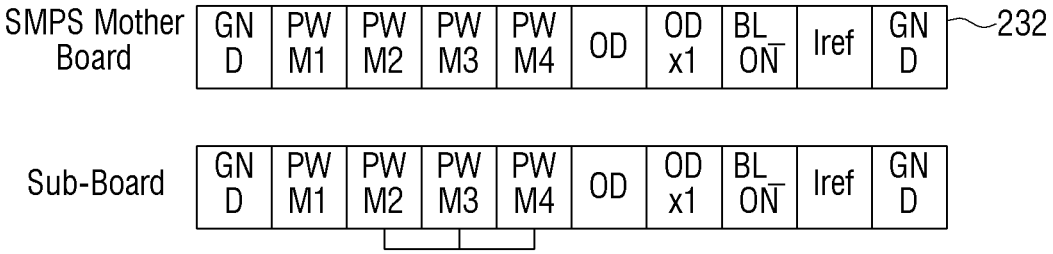
FIG. 7 is a diagram illustrating an example of a pin arrangement of a signal terminal of FIG. 5.

FIG. 7 is a diagram illustrating an example of a pin arrangement of a signal terminal of FIG. 5.

Referring to FIG. 7, the signal terminal 232 is composed of dimming terminals PWM1, PWM2, PWM3, and PWM4, control terminals OD, ODx1, BL_ON, and Iref, and a ground terminal GND.

The dimming terminals PWM1, PWM2, PWM3, and PWM4 are terminals that provide dimming signals transferred through the third board terminal to the LED driver 300.

The control terminals OD, ODx1, BL_ON, and Iref are terminals for transferring a plurality of control signals.

Figure 8:
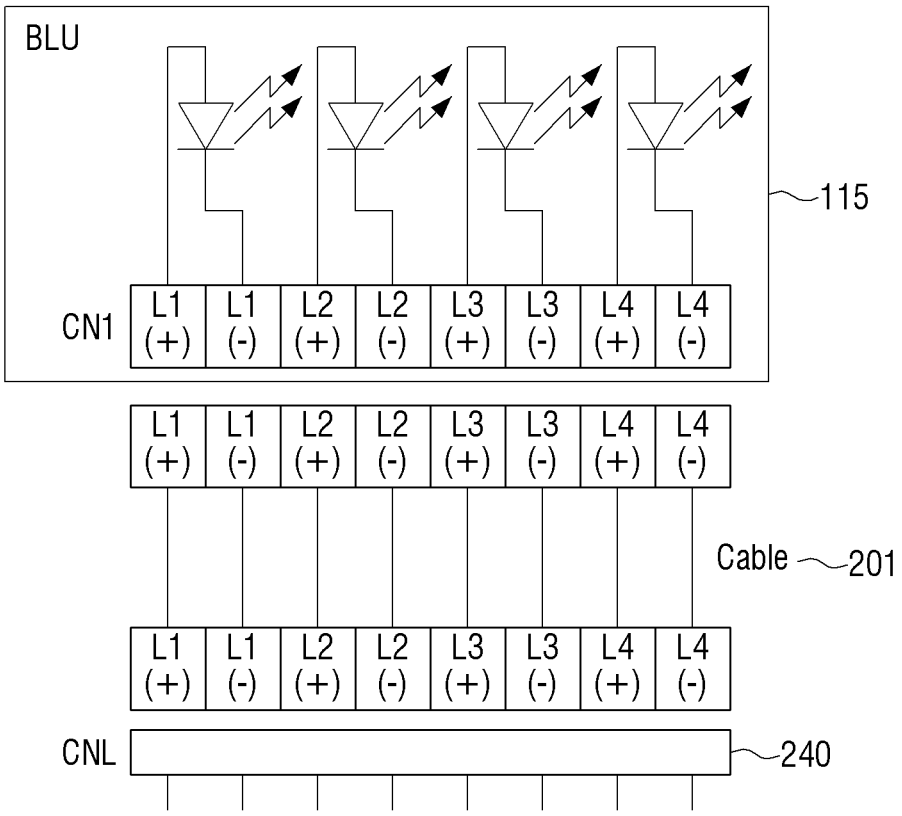
FIG. 8 is a diagram illustrating an example of a pin arrangement of a second board terminal of FIG. 5.

FIG. 8 is a diagram illustrating an example of a pin arrangement of a second board terminal of FIG. 5.

Referring to FIG. 8, the second board terminal 240 includes terminals corresponding to the number of LED arrays. For example, if the LED backlight 115 is connected to four LED arrays as shown in FIG. 8, the first board terminal 240 may be composed of 8 terminals. In this case, the LED backlight 115 and the second board terminal 240 may be connected through a cable 201.

On the other hand, if a plurality of constant currents are input through the first board terminal 230, the second board terminal 240 can individually provide the received constant currents to the plurality of LED arrays.

If one constant current is input through the first board terminal 230, the first board terminal 240 is connected in series to the plurality of LED arrays, and provides one constant current to the LED arrays connected in series. Specifically, if a pattern in which respective constant current terminals are connected to the sub-circuit substrate 310 of the LED driver 300 is constructed as shown in FIG. 6, four LED arrays on the side of the LED backlight 115 are arranged to be connected to each other in series.

Figure 9:
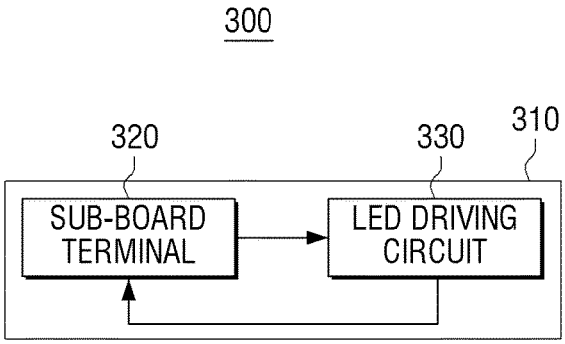
FIG. 9 is a block diagram illustrating the configuration of an LED driver according to an exemplary embodiment.
Figure 10:
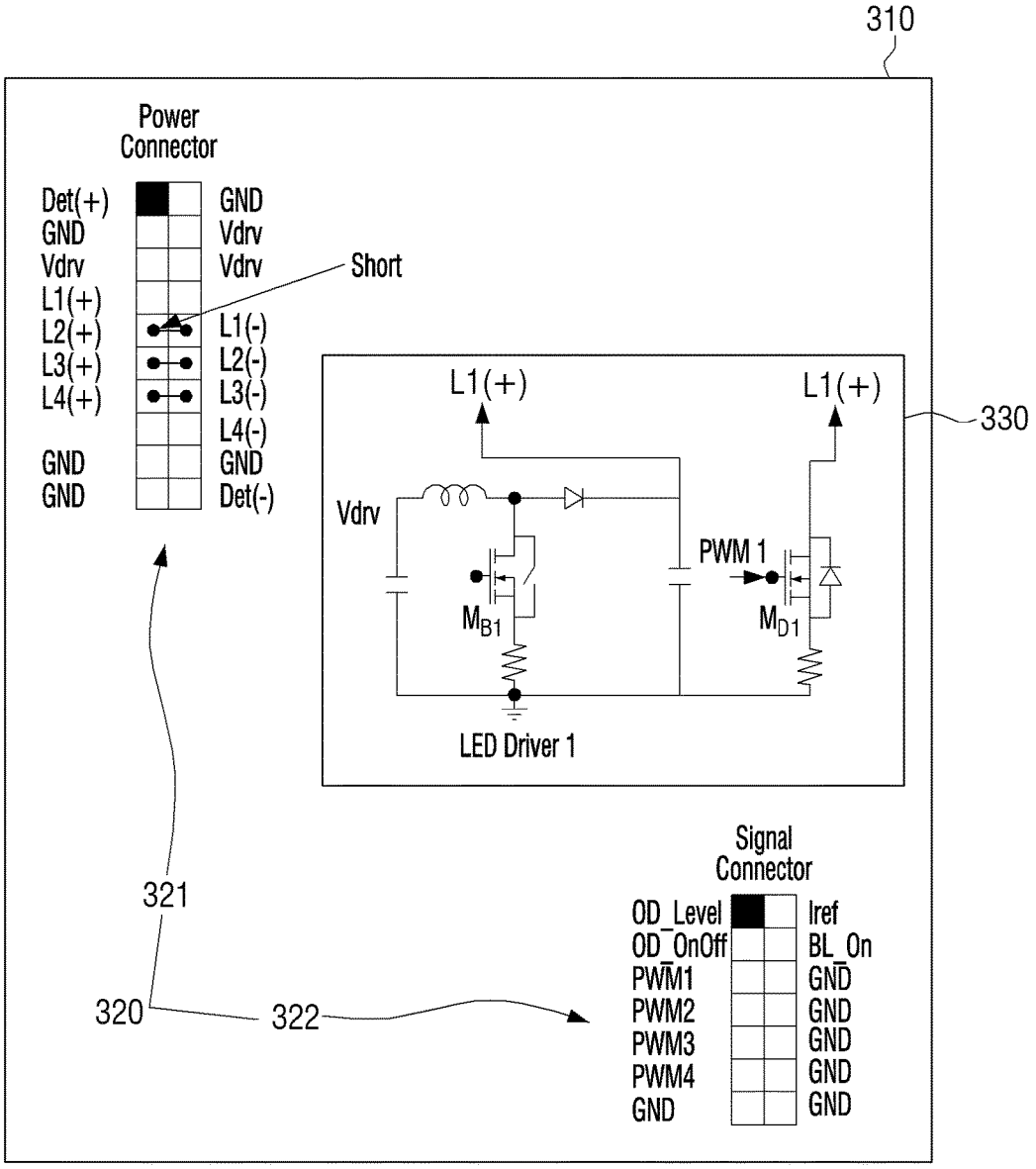
FIG. 10 is a diagram illustrating the form of a circuit board of an LED driver according to an exemplary embodiment.

FIG. 9 is a block diagram illustrating the configuration of an LED driver according to an exemplary embodiment, and FIG. 10 is a diagram illustrating the form of a circuit board of an LED driver according to an exemplary embodiment.

Referring to FIG. 9, the LED driver 300 may be composed of a sub-circuit terminal 320 and an LED driving circuit 330. The sub-circuit terminal 320 and the LED driving circuit 330 may be arranged on the sub-circuit board 310.

The sub-board terminal 320 is arranged on one side of the sub-circuit board 310 to face the first board terminal 220. The sub-board terminal 320 is configured to be arranged to face the first board terminal 220. Because this feature has been described with reference to FIGS. 6 and 7, the duplicate explanation thereof will be omitted.

The LED driving circuit 330 generates the constant current using the DC voltage that is transferred from the sub-board terminal. Specifically, the LED driving circuit may be of a boost type or a buck type, and may generate the constant current based on the DC voltage and the dimming signal transferred from the sub-board terminal 320. Referring to FIG. 10, a boost circuit is illustrated as an example of the LED driving circuit 330. However, in implementation, another buck circuit may be applied, or another LED driving circuit (new upgraded LED driving circuit) may be applied in addition of the two circuit types.

Further, the sub-board terminal 320 is composed of a plurality of terminals, and the plurality of terminals may be divided into a power terminal 321 and a signal terminal 322. In implementation, the power terminal 321 and the signal terminal 322 may be physically formed as one body, and may be divided into a plurality of groups as shown in FIG. 10.

The LED driving circuit 330 provides the generated constant current to the LED backlight through the sub-board terminal 320.

Figure 11:
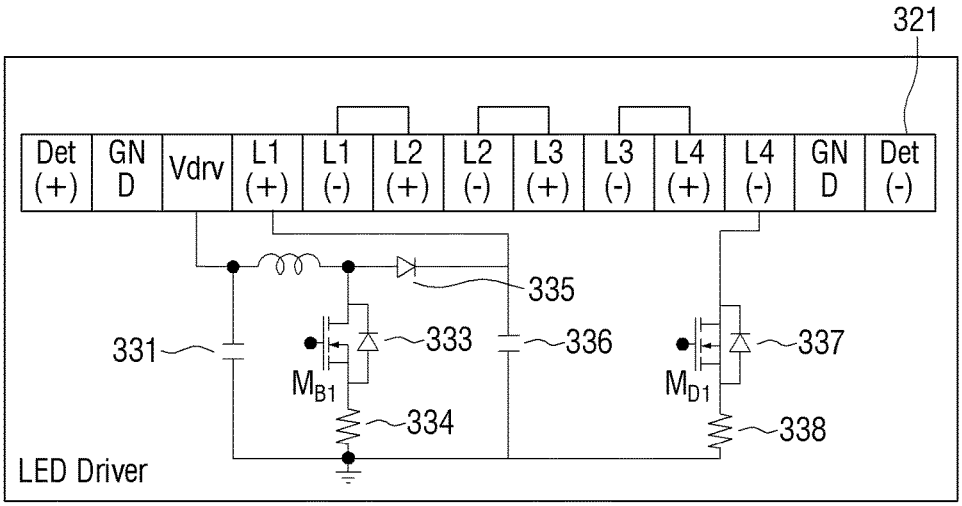
FIG. 11 is a circuit diagram of an LED driver according to an exemplary embodiment.

FIG. 11 is a circuit diagram of an LED driver according to an exemplary embodiment.

Referring to FIG. 11, a sub-board terminal 320 and boost circuits 331, 333, 334, 335, 336, 337, and 338 may be arranged on the sub-circuit board 310. The respective circuits may be connected through the pattern on the sub-circuit board 310.

In the illustrated example, on the sub-circuit board 310, a circuit pattern for mutually connecting the plurality of constant current terminals (L1(−1) and L2(+), L2(−1) and L3(+), and L3(−1) and L4(+)) is formed. Even if a plurality of LED arrays are independently arranged on the side of the LED backlight on which the LED arrays are arranged, the respective LED arrays may be mutually connected in series through the corresponding circuit pattern.

Figure 12:
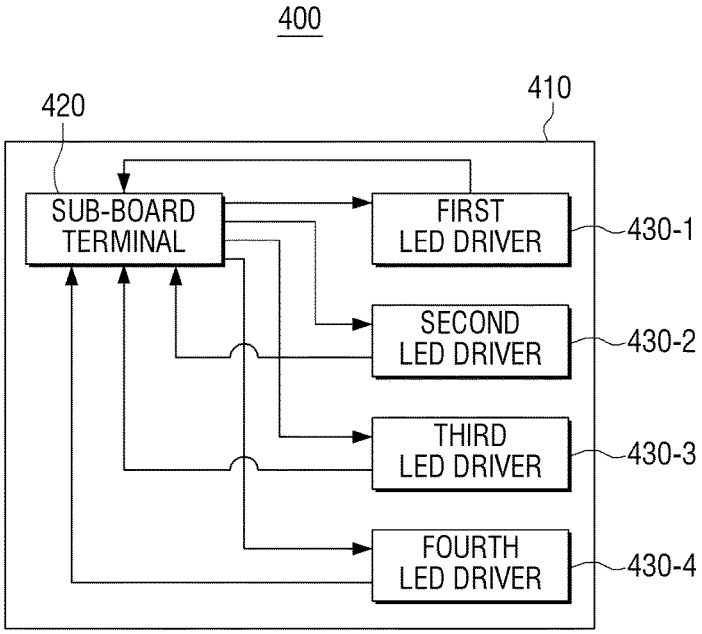
FIG. 12 is a circuit diagram of an LED driver according to another exemplary embodiment.
Figure 13:
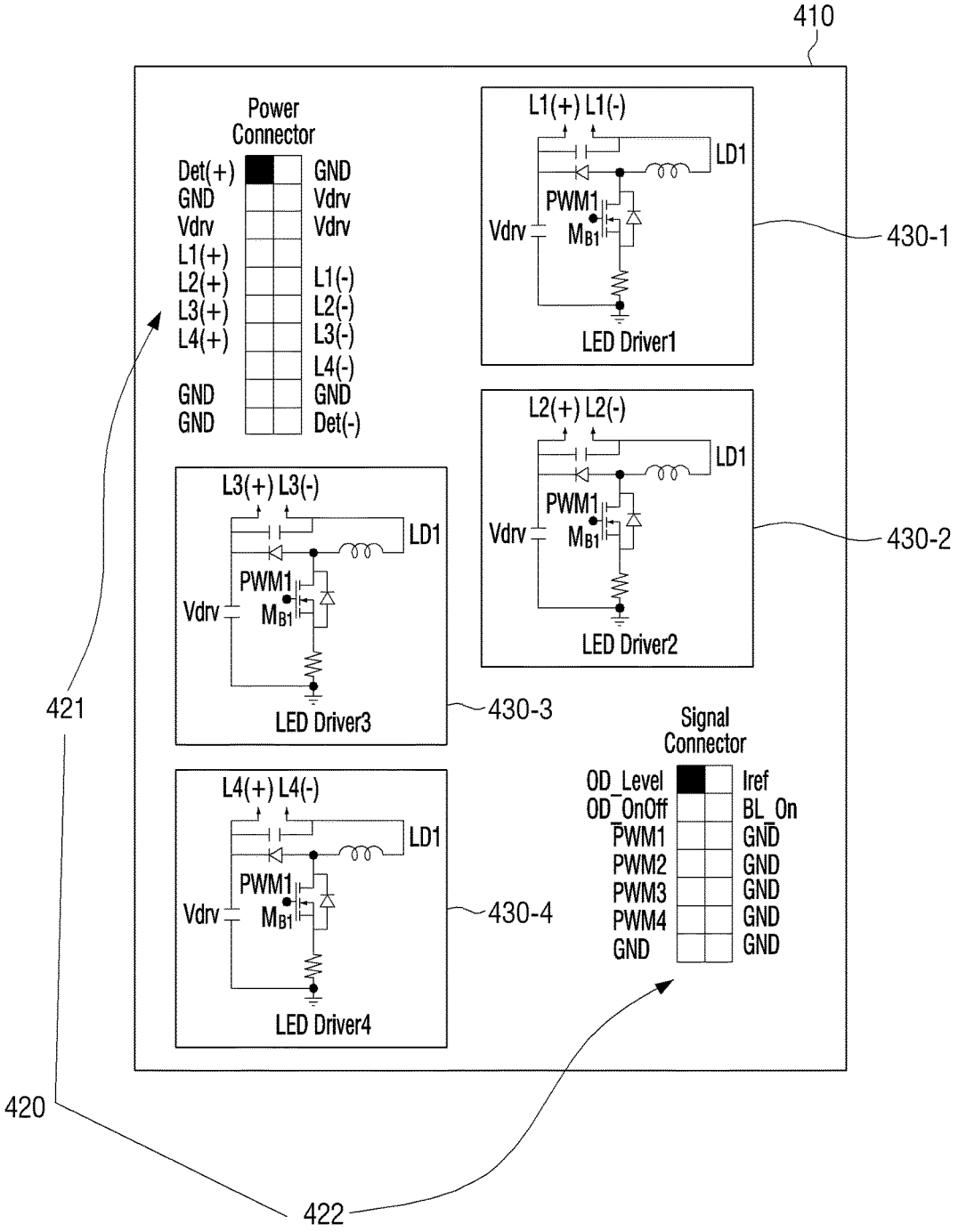
FIG. 13 is a diagram illustrating the form of a circuit board of an LED driver according to another exemplary embodiment.

FIG. 12 is a circuit diagram of an LED driver according to another exemplary embodiment, and FIG. 13 is a diagram illustrating the form of a circuit board of an LED driver according to another exemplary embodiment.

Referring to FIGS. 12 and 13, an LED driver 400 may be composed of a sub-circuit terminal 420 and a plurality of LED driving circuits 430-1, 430-2, 430-3, and 430-4. The sub-circuit terminal 420 and the plurality of LED driving circuits 430-1, 430-2, 430-3, and 430-4 may be arranged on a sub-circuit board 410.

The sub-board terminal 420 is arranged on one side of the sub-circuit substrate 410 to face the first board terminal 220. The sub-board terminal 420 is arranged to face the first board terminal 220. Because this feature has been described with reference to FIGS. 6 and 7, the duplicate explanation thereof will be omitted.

Each of the plurality of LED driving circuits 430-1, 430-2, 430-3, and 430-4 generates the constant current using the DC voltage that is transferred from the sub-board terminal. Specifically, the LED driving circuit 430 may be composed of a boost circuit or a buck circuit, and may generate the constant current based on the DC voltage and dimming signals transferred from the sub-board terminal 420.

Referring to FIG. 13, a buck circuit is illustrated as an example of the LED driving circuit 430. However, in implementation, another boost circuit may be applied, and another LED driving circuit (new upgraded LED driving circuit) may be applied in addition to the two circuit types. Further, although it is illustrated that four LED driving circuits are arranged, in implementation, two or three LED driving circuits may be arranged. Further, although it is illustrated that the respective LED driving circuits have the same circuit, in implementation, the respective LED driving circuit may be implemented by different driving type circuits.

Further, the LED driving circuits 430-1, 430-2, 430-3, and 430-4 may provide the generated constant current to the LED backlight through different terminals of the sub-board terminal 420.

The above-described hardware device may be configured to operate as one or more software modules and vice versa, in order to perform the operations according to various exemplary embodiments.

The foregoing exemplary embodiments and advantages are merely exemplary and are not to be construed as limiting the present disclosure. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A display device comprising:

a panel configured to display an image;

an LED backlight configured to emit light incident on the panel;

an image signal interface configured to provide an image signal to the panel;

a power supply; and an LED driver detachably coupled to the power supply via a mechanically detachable connection, wherein the power supply provides a DC voltage to the LED driver based on a connection state of the mechanically detachable connection, and wherein the LED driver generates constant current to be provided to the LED backlight based on the DC voltage, wherein the power supply comprises:

a circuit board;

a power generator arranged on the circuit board, the power generator configured to generate the DC voltage;

a first board terminal arranged a first side of the circuit board, the first board terminal comprising a power terminal configured to provide the DC voltage from the power generator to the LED driver and a signal terminal configured to receive the constant current generated by the LED driver from the LED backlight; and a second board terminal configured to provide the constant current to the LED backlight.

2. The display device as claimed in claim 1, wherein the LED backlight comprises a plurality of LED arrays, the signal terminal comprises a first plurality of sub-terminals configured to receive a plurality of constant currents, and the second board terminal comprises a second plurality of sub-terminals configured to provide the plurality of constant currents to the plurality of LED arrays, respectively.

3. The display device as claimed in claim 2, wherein the power supply further comprises a sensor configured to sense the connection state of the mechanically detachable connection.

4. The display device as claimed in claim 3, wherein the sensor is further configured to determine an electric potential value of a first sensor terminal of the first plurality of sub-terminals and determine the connection state based on the determined electric potential value.

5. The display device as claimed in claim 4, wherein the first sensor terminal is electrically connected by the LED driver to a second sensor terminal constituting the first board terminal when the LED driver is connected, and the second sensor terminal is connected to a ground of the circuit board through a resistor.

6. The display device as claimed in claim 1, wherein the LED backlight comprises a plurality of LED arrays, the signal terminal is further configured to receive one constant current provided thereto, and the second board terminal is further configured to commonly provide the one constant current provided thereto to different LED arrays of the plurality of LED arrays.

7. The display device as claimed in claim 1, wherein the LED driver comprises:

a sub-circuit board;

a first sub-board terminal arranged on a first side of the sub-circuit board to face the first board terminal; and an LED driving circuit configured to generate the constant current using the DC voltage from one terminal of the first sub-board terminal and to provide the generated constant current to another terminal of the first sub-board terminal.

8. The display device as claimed in claim 7, wherein the LED driving circuit is a buck type or a boost type.

9. The display device as claimed in claim 7, further comprising a plurality of LED driving circuits, wherein a plurality of constant currents are generated using different LED driving circuits of the plurality of LED driving circuits.

10. The display device as claimed in claim 1, wherein the power supply further comprises a third board terminal configured to receive dimming information from the image signal interface, and the first board terminal is configured to provide the received dimming information to the LED driver.

11. A power supply configured to generate a driving power to an LED driver, the power supply comprising:

a circuit board;

a power generator arranged on the circuit board, the power generator configured to generate a DC voltage;

an LED driver detachably attached to the circuit board via a mechanically detachable connection, the LED driver configured to generate constant current to be provided to an LED backlight using the generated DC voltage;

a sensor configured to sense a connection state of the mechanically detachable connection;

a first board terminal arranged on a first side of the circuit board, the first board terminal comprising a power terminal configured to provide the DC voltage from the power generator to the LED driver and a signal terminal configured to receive the constant current generated by the LED driver from the LED backlight; and a second board terminal arranged on a second side of the circuit board, the second board terminal configured to provide the constant current to the LED backlight, wherein the power generator is further configured to stop generation of the DC voltage based on the connection state of the sensor indicating the LED driver is detached.

12. The power supply as claimed in claim 11, wherein the LED backlight comprises a plurality of LED arrays, the signal terminal comprises a first plurality of sub-terminals configured to receive a plurality of constant currents provided thereto, and the second board terminal comprises a second plurality of sub-terminals configured to provide the plurality of constant currents to the plurality of LED arrays, respectively.

13. The power supply as claimed in claim 11, wherein the LED backlight comprises a plurality of LED arrays, the signal terminal is further configured to receive one constant current provided thereto, and the second board terminal is further configured to commonly provide the one constant current provided thereto to different LED arrays of the plurality of LED arrays.

14. The power supply as claimed in claim 11, wherein the LED driver comprises:

a sub-circuit board;

a first sub-board terminal arranged on a first side of the sub-circuit board to face the first board terminal; and an LED driving circuit configured to generate the constant current using the DC voltage from one terminal of the first sub-board terminal and to provide the generated constant current to another terminal of the first sub-board terminal.

15. The power supply as claimed in claim 14, wherein the LED driving circuit is a buck type or a boost type.

16. The power supply as claimed in claim 14, further comprising a plurality of LED driving circuits, wherein a plurality of constant currents are generated using different LED driving circuits of the plurality of LED driving circuits.

17. The power supply as claimed in claim 11, wherein the power supply further comprises a third board terminal configured to receive dimming information from an image signal interface, and the first board terminal is configured to provide the received dimming information to the LED driver.

18. The power supply as claimed in claim 11, wherein the sensor is further configured to sense an electric potential value of a first sensor terminal of a first plurality of sub-terminals and determine the connection state of the LED driver based on the sensed electric potential value.

19. The power supply as claimed in claim 18, wherein the first sensor terminal is electrically connected to a second sensor terminal constituting the first board terminal through the first plurality of sub-terminals, and the second sensor terminal is connected to a ground of the circuit board through a resistor.

* * * * *